US009779654B2

(12) United States Patent
He et al.

(10) Patent No.: US 9,779,654 B2
(45) Date of Patent: Oct. 3, 2017

(54) METHOD FOR IMAGE DISPLAY AND DISPLAY SYSTEM

(71) Applicant: Shenzhen China Star Optoelectronics Technology Co., Ltd., Shenzhen, Guangdong (CN)

(72) Inventors: Tao He, Guangdong (CN); Jhen-wei He, Guangdong (CN); Lei Sun, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 117 days.

(21) Appl. No.: 14/777,836

(22) PCT Filed: Jul. 8, 2015

(86) PCT No.: PCT/CN2015/083612
§ 371 (c)(1),
(2) Date: Sep. 17, 2015

(87) PCT Pub. No.: WO2017/004817
PCT Pub. Date: Jan. 12, 2017

(65) Prior Publication Data

US 2017/0004755 A1 Jan. 5, 2017

(30) Foreign Application Priority Data

Jul. 3, 2015 (CN) ..... 2015 1 0390177

(51) Int. Cl.
*G09G 5/02* (2006.01)
*G09G 3/3208* (2016.01)
(Continued)

(52) U.S. Cl.
CPC ..... *G09G 3/3208* (2013.01); *G09G 3/2003* (2013.01); *G09G 3/3607* (2013.01);
(Continued)

(58) Field of Classification Search
CPC ..... H04N 9/78; G09G 5/02; G09G 3/2003; G09G 3/2074; G09G 3/3208;
(Continued)

(56) References Cited

U.S. PATENT DOCUMENTS 8,884,995 B2 11/2014 Kwak
2009/0102769 A1* 4/2009 Kouno ..... G09G 3/3648 345/88
2016/0253942 A1* 9/2016 Tseng ..... G06T 11/001

FOREIGN PATENT DOCUMENTS

CN 104410849 A 10/2010
CN 103680467 A 3/2014
(Continued)

*Primary Examiner* — Kent Chang
*Assistant Examiner* — Mark Edwards
(74) *Attorney, Agent, or Firm* — Andrew C. Cheng

(57) ABSTRACT

A method for image display is provided. The method includes: providing a data signal of an image, and the data signal comprising grayscale values R, G, and B; obtaining brightness values LR, LG, and LB which the grayscale values R, G, and B correspond to; transforming the brightness values LR, LG, and LB into brightness values LR', LG', and LB'; obtaining grayscale values R', G', and B' which the brightness values LR', LG', and LB' correspond to; obtaining a minimum value among the grayscale values R, G, and B as a white grayscale value W'; and supplying the red subpixel, the green subpixel, the blue subpixel, and the white subpixel with the grayscale value R', G', B', and white grayscale value W', respectively so that the image can be shown on the display panel. The present invention also proposes a display system utilizing the method.

10 Claims, 1 Drawing Sheet

(51) Int. Cl.

| | |
|---|---|
| ***G09G 3/20*** | (2006.01) |
| ***G09G 3/36*** | (2006.01) |
| *G09G 5/06* | (2006.01) |

(52) U.S. Cl.

CPC ..... *G09G 5/06* (2013.01); *G09G 2300/0452* (2013.01); *G09G 2320/0242* (2013.01); *G09G 2320/0276* (2013.01); *G09G 2320/0673* (2013.01); *G09G 2340/06* (2013.01); *G09G 2360/16* (2013.01)

(58) Field of Classification Search

CPC ..... G09G 3/3607; G09G 2300/0443; G09G 2300/0452; G09G 2320/0242; G09G 2320/0673

USPC ..... 345/694

See application file for complete search history.

(56) References Cited

FOREIGN PATENT DOCUMENTS

| | | | |
|---|---|---|---|
| CN | 104410849 | A | 3/2015 |
| CN | 104575402 | A | 4/2015 |

* cited by examiner

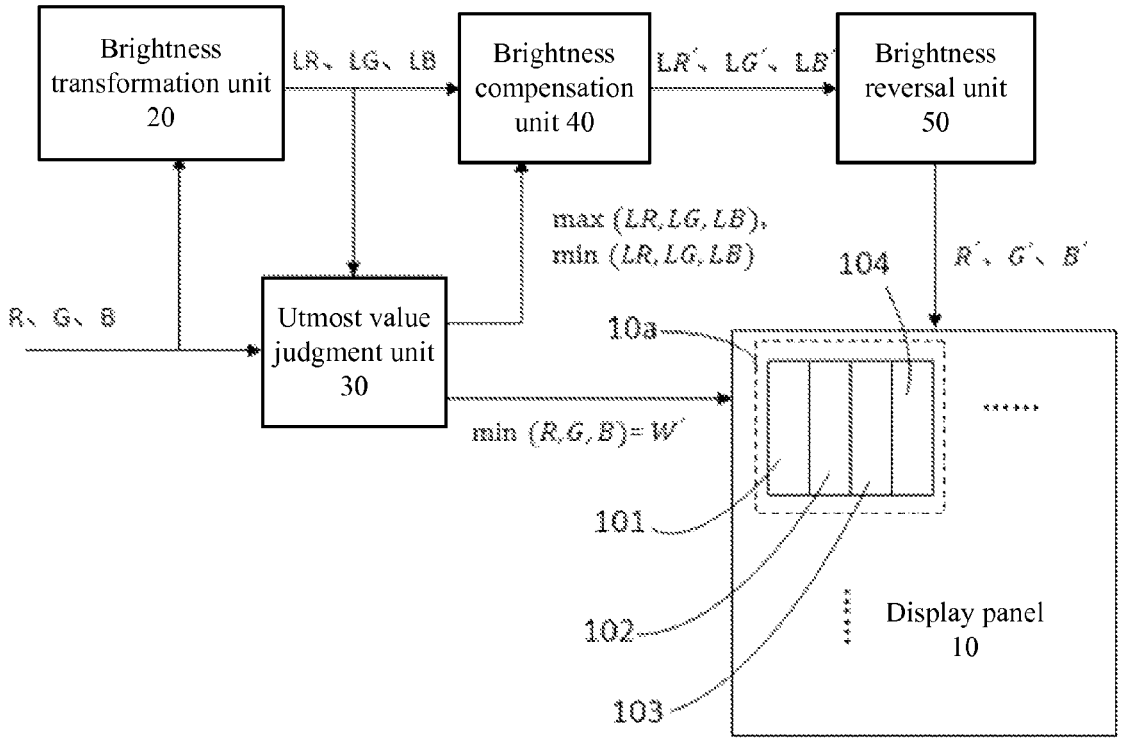
Brightness transformation unit 20
LR、LG、LB
Brightness compensation unit 40
LR′、LG′、LB′
Brightness reversal unit 50
max (LR, LG, LB), min (LR, LG, LB)
R′、G′、B′
104
R、G、B
Utmost value judgment unit 30
10a
min (R, G, B) = W′
101
102
103
Display panel 10

METHOD FOR IMAGE DISPLAY AND DISPLAY SYSTEM

BACKGROUND OF THE INVENTION

1. Field of the Invention

The present invention relates to the field of display technology, and more particularly, to a method for image display and a display system adopting the method.

2. Description of the Prior Art

Nowadays, a red (R) subpixel, a green (G) subpixel, and a blue (B) subpixel form a pixel for an image display device such as a liquid crystal display (LCD) panel and an organic light-emitting diode (OLED) panel. Any required colors can be successfully mixed and obtained to show colorful images by controlling the grayscale value of each of the subpixels. With the development of information technology (IT), demands for display panels with various features are increasing such as high rate of penetration, low power consumption, and high-quality imagery. A conventional method for mixing the RGB lights has a lower rate of penetration and a lower mixing efficiency while having a higher power consumption of the conventional display panel, which hinders optimization of the display panel. Therefore, a pixel having a R subpixel, a G subpixel, a B subpixel, and a white (W) subpixel is produced. The RGBW pixel is used for improving the display quality of the conventional RGB display panel.

A display panel adopting the RGBW pixels has following advantages: (1) The resolution of the subpixels is increased by one fourth. (2) The rate of penetration of the pixels is increased by 50%. (3) The R, G, B, and W pixels have more eleven-sixteenths color than the R, G, and B pixels do. Conventionally, the transmission interface of a signal is a transmission interface having the R, G, and B pixels. Images shown on a display panel having the R, G, B, and W pixels are easily to be distorted if a data signal carrying the R, G, and B pixels is used in such a display panel. To work successfully, a data signal carrying the R, G, and B pixels needs to be transformed into a data signal carrying the R, G, B, and W pixels, and then the data signal carrying the R, G, B, and W pixels has to be input to corresponding subpixels in the display panel.

Currently, the method for transforming a data signal carrying the R, G, and B pixels into a data signal carrying the R, G, B, and W pixels is as follows:

Firstly, obtaining the grayscale values R, G, and B which the data signal carrying the R, G, and B pixels corresponds to; next, calculating the corresponding grayscale values R', G', B', and W' which the data signal carrying the R, G, B, and W pixels corresponds to based on Equation (1) and Equation (2).

$$\frac{X' + \min(R, G, B)}{\max(R, G, B) + \min(R, G, B)} = \frac{X}{\max(R, G, B)} \quad (1)$$

$$W' = \min(R, G, B) \quad (2)$$

X needs to be the grayscale value R, G, or B. The min(R, G, B) is the minimum value among the grayscale values R, G, and B. The max(R, G, B) is the maximum value among the grayscale values R, G, and B in both of Equation (1) and Equation (2).

Based on the above-mentioned transformation method, the grayscale values R', G', B', and W' are obtained at once after the grayscale values R, G, and B are calculated. Using the obtained grayscale values R', G', B', and W', it is not possible to maintain as good chromaticity and saturation as when the original grayscale values R, G, and B are used.

SUMMARY OF THE INVENTION

In view of deficiencies of the conventional technology, an object of the present invention is to propose a method for image display. The method for image display is applied to a display panel comprising four pixels—the R pixel, the G pixel, the B pixel, and the W pixel. By improving the method of transformation of data signals, chromaticity and saturation for the transformed grayscale values R', G', B', and W' remain the same as those for the original grayscale values R, G, B, and W.

According to the present invention, a method for image display for used in a display panel comprising a plurality of pixels is proposed. Each of the plurality of pixels comprises a red subpixel, a green subpixel, a blue subpixel, and a white subpixel. The method comprises:

providing a data signal of an image, and the data signal comprising a first red grayscale value R, a first green grayscale value G, and a first blue grayscale value B;

obtaining a first red brightness value LR, a first green brightness value LG, and a first blue brightness value LB which the first red grayscale value R, the first green grayscale value G, and the first blue grayscale value B correspond to;

transforming the first red brightness value LR, the first green brightness value LG, and the first blue brightness value LB into a second red brightness value LR', a second green brightness value LG', and a second blue brightness value LB' used in the RGBW display panel;

obtaining a second red grayscale value R', a second green grayscale value G', and a second blue grayscale value B' which the second red brightness value LR', the second green brightness value LG', and a the second blue brightness value LB' correspond to;

obtaining a minimum value min (R, G, B) among the first red grayscale value R, the first green grayscale value G, and the first blue grayscale value B as a white grayscale value W'; and supplying the red subpixel, the green subpixel, the blue subpixel, and the white subpixel with the second red grayscale value R', the second green grayscale value G', the second blue grayscale value B', and white grayscale value W', respectively so that the image can be shown on the RGBW display panel.

Furthermore, the second red brightness value LR', the second green brightness value LG', and the second blue brightness value LB' are acquired after calculation based on an equation:

$$\frac{X' + \min(LR, LG, LB)}{\max(LR, LG, LB) + \min(LR, LG, LB)} = \frac{X}{\max(LR, LG, LB)},$$

and in the equation, X substitutes LR', LG', or LB', correspondingly, X needs to be the brightness value LR, LG, or LB, a max(LR, LG, LB) is the maximum value among the brightness values LR, LG, and LB, and a min(LR, LG, LB) is the minimum value of the brightness values LR, LG, and LB.

Furthermore, transformation of the grayscale values and the brightness values is achieved through a gamma curve.

Furthermore, a gamma value is 2.2 in the gamma curve.

Furthermore, transformation of the grayscale values and the brightness values is acquired through a look-up-table (LUT).

Furthermore, the display panel is a liquid crystal display (LCD) panel or an organic light-emitting diode (OLED) panel.

According to the present invention, a system of image display comprises:

a display panel, comprising a plurality of pixels, and each of the plurality of pixels comprising a red subpixel, a green subpixel, a blue subpixel, and a white subpixel;

a brightness transformation unit, receiving a first red grayscale value R, a first green grayscale value G, and a first blue grayscale value B of an image, transforming the first red grayscale value R into a corresponding first red brightness value LR, the first green grayscale value G into a corresponding first green brightness value LG, and the first blue grayscale value B into a corresponding first blue brightness value LB;

an utmost value judgment unit, receiving the first red brightness value LR, the first green brightness value LG, and the first blue brightness value LB output by the brightness transformation unit, judging a maximum value max(LR, LG, LB) and a minimum value min(LR, LG, LB), inputting the maximum value max(LR, LG, LB) and the minimum value min(LR, LG, LB) to the brightness compensation unit, receiving the first red grayscale value R, the first green grayscale value G, and the first blue grayscale value B of the image, judging the minimum value to be a min(LR, LG, LB), and outputting the min(LR, LG, LB) as a white grayscale value W';

a brightness compensation unit, receiving the first red brightness value LR, the first green brightness value LG, and the first blue brightness value LB output by the brightness transformation unit, receiving the maximum value max(LR, LG, LB) and the minimum value min(LR, LG, LB) output by the utmost value judgment unit, calculating a second red brightness value LR', a second green brightness value LG', and a second blue brightness value LB' based on the received data; and a brightness reversal unit, receiving the second red brightness value LR', the second green brightness value LG', and the second blue brightness value LB' output by the brightness compensation unit, and transforming the second red brightness value LR' into a corresponding second red grayscale value R', the second green brightness value LG' into a corresponding second green grayscale value G', and the second blue brightness value LB' into a corresponding second blue grayscale value B';

wherein the red subpixel, the green subpixel, the blue subpixel, and the white subpixel receive the second red grayscale value R', the second green grayscale value G', the second blue grayscale value B', and the white grayscale value W', respectively so that the image can be shown on the display panel.

Furthermore, the brightness compensation unit acquires the second red brightness value LR', the second green brightness value LG', and the second blue brightness value LB' after calculation based on an equation:

$$\frac{X' + \min(LR, LG, LB)}{\max(LR, LG, LB) + \min(LR, LG, LB)} = \frac{X}{\max(LR, LG, LB)},$$

and in the equation, X' substitutes LR', LG', or LB', correspondingly, X needs to be the brightness value LR, LG, or LB, a max(LR, LG, LB) is the maximum value among the brightness values LR, LG, and LB, and a min(LR, LG, LB) is the minimum value of the brightness values LR, LG, and LB.

Furthermore, the brightness transformation unit and the brightness reversal unit transforms the grayscale values into the brightness values through a gamma curve.

Furthermore, a gamma value is 2.2 in the gamma curve.

Furthermore, the brightness transformation unit and the brightness reversal unit transforms the grayscale values into the brightness values through a look-up-table (LUT).

Furthermore, the display panel is a liquid crystal display (LCD) panel or an organic light-emitting diode (OLED) panel.

Compared with conventional technology, a method for image display and a display system adopting the method proposed by the present invention have a feature as follow: Grayscale values are transformed into corresponding brightness values at first; next, the data signal carrying the R, G, B, and W pixels obtains corresponding compensated brightness values after the brightness values are calculated; next, the brightness values which the data signal carrying the R, G, B, and W pixels corresponds to are transformed into grayscale values in the process of transforming the data signal carrying the R, G, and B pixels into the data signal carrying the R, G, B, and W pixels. By adopting the brightness values as the median of grayscale, it is possible to maintain as good chromaticity and saturation using the transformed grayscale values R', G', B', and W', as when the grayscale values R, G, and B are used.

BRIEF DESCRIPTION OF THE DRAWINGS

FIG. 1 shows a black diagram of an image display system according to a preferred embodiment of the present invention.

DETAILED DESCRIPTION OF THE PREFERRED EMBODIMENTS

For better understanding embodiments of the present invention, the following detailed description taken in conjunction with the accompanying drawings is provided. Apparently, the accompanying drawings are merely for some of the embodiments of the present invention. Any ordinarily skilled person in the technical field of the present invention could still obtain other accompanying drawings without use laborious invention based on the present accompanying drawings.

Please refer to FIG. 1. An image display system is proposed by an embodiment of the present invention. The system comprises a display panel 10, a brightness transformation unit 20, an utmost value judgment unit 30, a brightness compensation unit 40, and a brightness reversal unit 50.

The display panel 10 comprises a plurality of pixels 10*a*. Each of the plurality of pixels 10*a* comprises a red subpixel 101, a green subpixel 102, a blue subpixel 103, and a white subpixel 104. The display panel 10 may be an LCD panel or an OLED panel.

The brightness transformation unit 20 receives a first red grayscale value R, a first green grayscale value G, and a first blue grayscale value B. Next, the brightness transformation unit 20 transforms the first red grayscale value R into a corresponding first red brightness value LR, the first green grayscale value G into a corresponding first green brightness value LG, and the first blue grayscale value B into a corresponding first blue brightness value LB. Afterwards, the first red brightness value LR, the first green brightness value LG, and the first blue brightness value LB are input to the utmost value judgment unit 30 and the brightness compensation unit 40.

While receiving the first red brightness value LR, the first green brightness value LG, and the first blue brightness value LB output by the brightness transformation unit 20, the utmost value judgment unit 30 judges a maximum value max(LR, LG, LB) and a minimum value min(LR, LG, LB) and inputs the maximum value max(LR, LG, LB) and the minimum value min(LR, LG, LB) to the brightness compensation unit 40. On the other hand, the utmost value judgment unit 30 receives the first red grayscale value R, the first green grayscale value G, and the first blue grayscale value B of the image and judges the minimum value to be min(R, G, B). Afterwards, the utmost value judgment unit 30 outputs the min(R, G, B) as a white grayscale value W'.

While receiving the first red brightness value LR, the first green brightness value LG, and the first blue brightness value LB output by the brightness transformation unit 20, the brightness compensation unit 40 receives the maximum value max(LR, LG, LB) and the minimum value min(LR, LG, LB) output by the utmost value judgment unit 30. Further, the brightness compensation unit 40 calculates a second red brightness value LR', a second green brightness value LG', and a second blue brightness value LB' used for the display panel comprising the R, G, B, and W pixels based on the received data. Next, the brightness compensation unit 40 inputs the second red brightness value LR', the second green brightness value LG', and the second blue brightness value LB' to the brightness reversal unit 50.

The brightness reversal unit 50 receives the second red brightness value LR', the second green brightness value LG', and the second blue brightness value LB' output by the brightness compensation unit 40. Next, the brightness reversal unit 50 transforms the second red brightness value LR' into a corresponding second red grayscale value R', the second green brightness value LG' into a corresponding second green grayscale value G', and the second blue brightness value LB' into a corresponding second blue grayscale value B'. Afterwards, the brightness reversal unit 50 outputs the second red grayscale value R', the second green grayscale value G', and the second blue grayscale value B'.

The red subpixel 101, the green subpixel 102, and the blue subpixel 103 in the display panel 10 receive the second red grayscale value R', the second green grayscale value G', and the second blue grayscale value B' output by the brightness reversal unit 50, respectively. The white subpixel 104 receives the white grayscale value W' output by the utmost value judgment unit 30. Finally, the image is shown on the display panel 10.

The method for image display of the display system as described above comprises steps of:

Step 1: Inputting a data signal carrying the R, G, and B pixels of an image to a brightness transformation unit 20 and an utmost value judgment unit 30. The data signal carrying the R, G, and B pixels of the image comprises a first red grayscale value R, a first green grayscale value G, and a first blue grayscale value B.

Step 2: Transforming the first red grayscale value R, the first green grayscale value G, and the first blue grayscale value B into a corresponding first red brightness value LR, a corresponding first green brightness value LG, and a corresponding first blue brightness value LB, respectively, and then inputting the first red brightness value LR, the first green brightness value LG, and the first blue brightness value LB to the utmost value judgment unit 30 and a brightness compensation unit 40 through the brightness transformation unit 20. The transformation of the grayscale values and the brightness values is achieved through a gamma curve. Preferably, 2.2 is the gamma value. The transformation of the grayscale values and the brightness values can be also acquired through a look-up-table (LUT) in another embodiment.

Step 3: Judging the first red brightness value LR, the first green brightness value LG, and the first blue brightness value LB, concluding a maximum value max(LR, LG, LB) and a minimum value min(LR, LG, LB), and inputting the maximum value max(LR, LG, LB) and the minimum value min(LR, LG, LB) to the brightness compensation unit 40 through the utmost value judgment unit 30; besides, judging the first red grayscale value R, the first green grayscale value G, and the first blue grayscale value B, concluding a minimum value min(R, G, B), and giving the minimum value min(R, G, B) as a white grayscale value W' to a white subpixel 104 of a display panel 10.

Step 4: Calculating a second red brightness value LR', a second green brightness value LG', and a second blue brightness value LB' used for the display panel comprising the R, G, B, and W pixels based on the first red brightness value LR, the first green brightness value LG, the first blue brightness value LB, the maximum value max(LR, LG, LB) among the three brightness values, and the minimum value min(LR, LG, LB) among the three brightness values through the brightness compensation unit 40. To be specific, Step 4 is realized based on the following equation:

$$\frac{X' + \min(LR, LG, LB)}{\max(LR, LG, LB) + \min(LR, LG, LB)} = \frac{X}{\max(LR, LG, LB)}$$

where X' indicates LR', LG', or LB'; correspondingly, X needs to be the brightness value LR, LG, or LB.

Step 5: Transforming the second red brightness value LR', the second green brightness value LG', and the second blue brightness value LB' to a corresponding second red grayscale value R', a corresponding second green grayscale value G', and a corresponding second blue grayscale value B', respectively, and correspondingly, providing the second red grayscale value R', the second green grayscale value G', and the second blue grayscale value B' to a red subpixel 101, a green subpixel 102, and a blue subpixel 103 in the display panel 10 through the brightness reversal unit 50. The transformation of the grayscale values and the brightness values is achieved through a gamma curve. Preferably, 2.2 is the gamma value. The transformation of the grayscale values and the brightness values can be acquired through a look-up-table (LUT) as well in another embodiment.

Step 6: Receiving the second red brightness value LR', the second green brightness value LG', the second blue brightness value LB', and the white grayscale value W' and displaying a corresponding image on the display panel 10.

In conclusion, the present invention proposes the method for image display and a display system adopting the method. In the process of transforming the data signal carrying the R, G, and B pixels into the data signal carrying the R, G, B, and W pixels, grayscale values are transformed into corresponding brightness values at first; next, the data signal carrying the R, G, B, and W pixels obtains corresponding compensated brightness values after the brightness values are calculated; next, the brightness values which the data signal carrying the R, G, B, and W pixels corresponds to are transformed into grayscale values. By adopting the brightness values as the median of grayscale, it is possible to maintain as good chromaticity and saturation using the transformed grayscale values R', G', B', and W', as when the original grayscale values R, G, and B are used.

The terms "a" or "an", as used herein, are defined as one or more than one. The term "another", as used herein, is defined as at least a second or more. The terms "including" and/or "having" as used herein, are defined as comprising. It should be noted that if it is described in the specification that one component is "connected," "coupled" or "joined" to another component, a third component may be "connected," "coupled," and "joined" between the first and second components, although the first component may be directly connected, coupled or joined to the second component.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A method for image display for use in a display panel, each of the plurality of pixels comprising a red subpixel, a green subpixel, a blue subpixel, and a white subpixel, and the method comprising:

providing a data signal of an image, and the data signal comprising a first red grayscale value R, a first green grayscale value G, and a first blue grayscale value B;

obtaining a first red brightness value LR, a first green brightness value LG, and a first blue brightness value LB which the first red grayscale value R, the first green grayscale value G, and the first blue grayscale value B correspond to;

transforming the first red brightness value LR, the first green brightness value LG, and the first blue brightness value LB into a second red brightness value LR', a second green brightness value LG', and a second blue brightness value LB' used in the RGBW display panel;

obtaining a second red grayscale value R', a second green grayscale value G', and a second blue grayscale value B' which the second red brightness value LR', the second green brightness value LG', and a the second blue brightness value LB' correspond to;

obtaining a minimum value min (R, G, B) among the first red grayscale value R, the first green grayscale value G, and the first blue grayscale value B as a white grayscale value W'; and supplying the red subpixel, the green subpixel, the blue subpixel, and the white subpixel with the second red grayscale value R', the second green grayscale value G', the second blue grayscale value B', and white grayscale value W', respectively so that the image can be shown on the RGBW display panel;

wherein the second red brightness value LR', the second green brightness value LG', and the second blue brightness value LB' are acquired after calculation based on an equation:

$$\frac{X' + \min(LR, LG, LB)}{\max(LR, LG, LB) + \min(LR, LG, LB)} = \frac{X}{\max(LR, LG, LB)},$$

and in the equation, X' substitutes LR', LG', or LB', correspondingly, X is the brightness value LR, LG, or LB, a max(LR, LG, LB) is the maximum value among the brightness values LR, LG, and LB, and a min(LR, LG, LB) is the minimum value of the brightness values LR, LG, and LB.

2. The method for image display of claim 1, wherein transformation of the grayscale values and the brightness values is achieved through a gamma curve.

3. The method for image display of claim 2, wherein a gamma value is 2.2 in the gamma curve.

4. The method for image display of claim 1, wherein transformation of the grayscale values and the brightness values is acquired through a look-up-table (LUT).

5. The method for image display of claim 1, wherein the display panel is a liquid crystal display (LCD) panel or an organic light-emitting diode (OLED) panel.

6. A display system of image display, comprising:

a display panel, comprising a plurality of pixels, and each of the plurality of pixels comprising a red subpixel, a green subpixel, a blue subpixel, and a white subpixel;

a brightness transformation unit, receiving a first red grayscale value R, a first green grayscale value G, and a first blue grayscale value B of an image, transforming the first red grayscale value R into a corresponding first red brightness value LR, the first green grayscale value G into a corresponding first green brightness value LG, and the first blue grayscale value B into a corresponding first blue brightness value LB;

an utmost value judgment unit, receiving the first red brightness value LR, the first green brightness value LG, and the first blue brightness value LB output by the brightness transformation unit, judging a maximum value max(LR, LG, LB) and a minimum value min(LR, LG, LB) to the brightness compensation unit, receiving the first red grayscale value R, the first green grayscale value G, and the first blue grayscale value B of the image, judging the minimum value to be a min(LR, LG, LB), and outputting the min(LR, LG, LB) as a white grayscale value W';

a brightness compensation, receiving the first red brightness value LR, the first green brightness value LG, and the first blue brightness value LB output by the brightness transformation unit, receiving the maximum value max(LR, LG, LB) and the minimum value min(LR, LG, LB) output by the utmost value judgment unit, calculating a second red brightness value LR', a second green brightness value LG', and a second blue brightness value LB' based on the received data; and a brightness reversal unit, receiving the second red brightness value LR', the second green brightness value LG', and the second blue brightness value LB' output by the brightness compensation unit, and transforming the second red brightness value LR' into a corresponding second red grayscale value R', the second green brightness value LG' into a corresponding second green grayscale value G', and the second blue brightness value LB' into a corresponding second blue grayscale value B';

wherein the red subpixel, the green subpixel, the blue subpixel, and the white subpixel receive the second red grayscale value R', the second green grayscale value G', the second blue grayscale value B', and the white grayscale value W', respectively so that the image can be shown on the display panel;

wherein the brightness compensation unit acquires the second red brightness value LR', the second green brightness value LG', and the second blue brightness value LB' after calculation based on an equation:

$$\frac{X' + \min(LR, LG, LB)}{\max(LR, LG, LB) + \min(LR, LG, LB)} = \frac{X}{\max(LR, LG, LB)},$$

and in the equation, X' substitutes LR', LG', or LB', correspondingly, X is the brightness value LR, LG, or LB, a max(LR, LG, LB) is the maximum value among the brightness values LR, LG, and LB, and a min(LR, LG, LB) is the minimum value of the brightness values LR, LG, and LB.

7. The display system of claim 6, wherein the brightness transformation unit and the brightness reversal unit transforms the grayscale values into the brightness values through a gamma curve.

8. The display system of claim 7, wherein a gamma value is 2.2 in the gamma curve.

9. The display system of claim 6, wherein the brightness transformation unit and the brightness reversal unit transforms the grayscale values into the brightness values through a look-up-table (LUT).

10. The display system of claim 6, wherein the display panel is a liquid crystal display (LCD) panel or an organic light-emitting diode (OLED) panel.

* * * * *